United States Patent [19]

Jobson

[11] 3,980,554

[45] Sept. 14, 1976

[54] ORE WASHING MACHINE

[76] Inventor: Kenneth C. Jobson, 1117 J St., Sacramento, Calif. 95814

[22] Filed: May 12, 1975

[21] Appl. No.: 576,593

[52] U.S. Cl. ..... 209/240; 209/269; 209/327

[51] Int. Cl.[2] ..... B07B 1/28

[58] Field of Search ..... 209/269, 315, 317, 327, 209/331, 337, 259, 240, 333

[56] References Cited

UNITED STATES PATENTS

| | | | |
|---|---|---|---|
| 365,343 | 6/1887 | Kron | 209/269 |
| 2,074,515 | 3/1937 | Pyatt | 209/331 X |
| 2,106,742 | 2/1938 | Hinkle | 209/315 X |
| 2,587,498 | 2/1952 | Marsh | 209/315 X |
| 2,764,291 | 9/1956 | Vigeant | 209/269 |
| 3,315,807 | 4/1967 | Rosen | 209/337 X |

FOREIGN PATENTS OR APPLICATIONS

| | | | |
|---|---|---|---|
| 659,294 | 10/1951 | United Kingdom | 209/269 |

*Primary Examiner*—Robert Halper
*Attorney, Agent, or Firm*—Flehr, Hohbach, Test

[57] ABSTRACT

An ore washing machine is disclosed which comprises an elongate box mounted on rollers for simultaneous rolling and rocking movement transversely of the longitudinal axis of the box. A plurality of horizontally extending, superposed screens are mounted within the box at substantially the mid-span of the side and end walls. Arcuate corners which join the side and end walls with the bottom wall are formed with radii which are sized within the range of one-fourth to one-half of the vertical distance between the lowermost screen and the bottom wall. An operating arm and yoke are connected with one side wall at the level of the lowermost screen for imparting a reciprocating thrust force to the box so that a charge of ore and water which is deposited in the box is caused to move in a figure eight path for an improved washing action. The fines passing through the screens move upwardly through a discharge spout which is oriented at an angle of 45° or less with respect to a side wall. Heavier ore, rock, stones and disolved clay and talc in the water are discharged through a chute in an end wall of the box.

4 Claims, 3 Drawing Figures

ORE WASHING MACHINE

BACKGROUND OF THE INVENTION

This invention relates in general to ore washing machines and in particular relates to an improvement in an ore washing machine of the type disclosed in U.S. Pat. No. 2,764,291 to Vigeant dated Sept. 25, 1956.

In the ore washing machine of the aforementioned patent a box is mounted on rollers and is operated by an eccentric drive which moves the box in a rolling and rocking motion. Infeed material which is directed into the box is washed on screens so that the fines pass through the screens for discharge through a spout while the larger sized material and residue is carried away through a discharge chute. However, the washing action has not been found to be optimum in such machines. When in use, there has not been a satisfactory degree of separation of the desired mineral content such as gold, silver, platinum and the like. There is, therefore, a need for an improved ore washing machine which will obtain more satisfactory results in the washing and separting of mineral ores.

OBJECTS AND SUMMARY OF THE INVENTION

It is a general object of the invention to provide a new and improved ore washing machine of the type disclosed in the aforementioned patent.

Another object is to provide an ore washing machine of the type described which is configured and operated in a manner which causes an infeed charge to move in a figure eight path within the washing box.

Another object is to provide a machine of the type described in which the operating rod is connected with a side wall of the box at a relatively low position such that a more uniform rocking and rolling action is imparted to the box.

Another object is to provide a machine of the type described in which the end and side walls are joined with the bottom wall by arcuate corners having radii sized within the range of one-fourth to one-half of the vertical distance between the lowermost screen and the bottom wall whereby the contained charge is directed in a figure eight path as the box is moved in a rolling and rocking motion.

Another object is to provide a machine of the type described in which one or more discharge spouts are positioned to extend upwardly from lower portions of the box at angles of 45° or less with respect to the side walls for optimum separation of ore fines from the charge within the box.

The invention in summary includes an ore washing box having spaced side and end walls which are joined with a bottom wall by arcuate corners. A plurality of superposed screens are mounted within the box at the mid-span of the side and end walls. The box is mounted on rollers for a rolling and rocking movement in a direction transverse of the longitudinal axis. The box is operated by means of a yoke which is connected to one side wall at a position substantially at the level of the lowermost screen. A conveyer feeds a charge of ore into one end of the box and the charge is caused to move in a figure eight path by the rolling and rocking movement acting in cooperation with the arcuate corners. Ore fines are passed downwardly through the screen and then upwardly through discharge spouts which are oriented at an angle of 45° or less with respect to the side walls. Larger size material and residue water exits from an end of the box, through a discharge chute.

The foregoing and additional objects and features of the invention will become apparent from the following description in which the preferred embodiments have been set forth in detail in conjunction with the accompanying drawings.

DESCRIPTION OF THE PREFERRED EMBODIMENT

Figure 1:
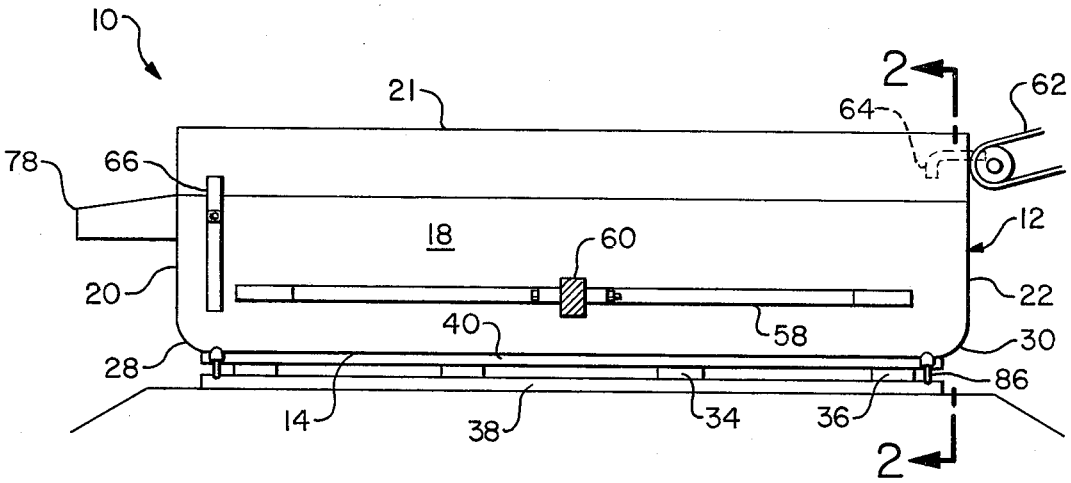
FIG. 1 is a side elevational view of an ore washing machine of the invention.
Figure 2:
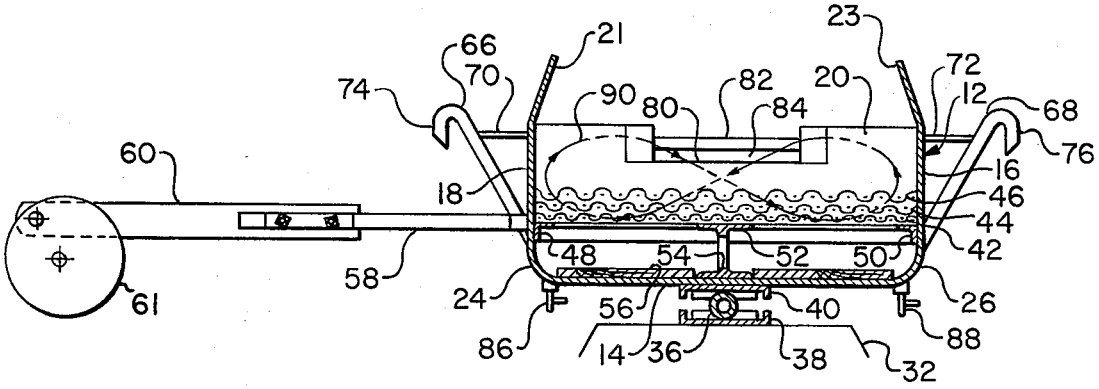
FIG. 2 is a cross sectional view taken along the line 2—2 of FIG. 1.

In the drawings FIG. 1 illustrates generally at 10 an ore washing machine constructed in accordance with the invention. Ore washing machine 10 comprises an upwardly open elongate box 12 defined by a bottom wall 14, a pair of laterally spaced apart side walls 16, 18, and a pair of longitudally spaced apart end walls 20, 22. A pair of deflector plates 21,23 are mounted above the side walls for retaining the charge within the box. The side walls are joined with the bottom wall by means of a pair of arcuate corners 24, 26 while the end walls are joined with the bottom wall by a pair of arcuate corners 28, 30. The arcuate corners define inwardly concave surfaces which contribute to the improved operation of the machine in a manner to be subsequently described.

Box 12 is supported above a suitable foundation 32 by means of a plurality of rollers 34, 36 which are mounted at spaced-apart positions below bottom wall 14 and extend concentrically along an axis parallel with the longitudal axis of the box. The rollers are guided for movement between lateral extremities of travel relative to the foundation by channel iron 38, while a channel iron 40 mounted on the bottom wall limits the extremities of travel of the roller with respect to the box.

A plurality of screens 42,44 and 46 are mounted within box 12 by means of angle irons 48, 50 secured about the side and end walls, and by an I-beam 52 which extends longitudally within the box. The I-beam is formed with a plurality of openings 54 which permit lateral charge circulation within the box. The lowermost screen 42 comprises a fine mesh screen having openings within the range of ¼ inch to ⅛ inch. The intermediate screen 44 lies above screen 42 and preferably comprises metal bars welded together to form openings of about 2 inches in width. Upper screen 46 preferably comprises heavier metal bars secured together as by welding to form openings of about four inches in width. The screens are mounted so that they incline down at a small angle on the order of 1° in the direction from end wall 22 to end wall 20. Flat wooden boards 56 are mounted on the upper surfaces of bottom wall 14 to protect the latter from abrasive wear due to the charge of material within the box.

Machine 10 is operated for simultaneous rolling and rocking motion by drive means which comprises a yoke 58 and connecting rod 60. The yoke is mounted to side wall 18 at a position substantially level with the lowermost screen 42. Connecting rod 60 is mounted at one end by suitable fasteners to the yoke and is operatively connected at its opposite end to a suitable eccentric drive 61, shown schematically, powered by a motor, not shown. Operation of the eccentric drive causes the connecting rod and yoke to impart a reciprocating push and pull force to the box and at the same time pivot the box through an angle about the fulcrum defined by the rollers. This action causes the box to rock while transversely moving back and forth with an amplitude equal to the stroke of the connecting rod.

Suitable material infeed means such as the conveyor 62 is mounted above end wall 22 for depositing a charge of ore and rock material into the upstream end of the box. A pipe 64 projects over end wall 22 for directing a charge of water into the box through operation of a suitable valve, not shown. A pair of ore fines discharge spouts 66 and 68 are mounted on opposite sides of the box. The discharge spout 68 is mounted at its lower end through side wall 16 at the upstream end of the box, while discharge spout 66 is mounted at its lower end through side wall 18 at the downstream end of the box. Each of the discharge spouts are oriented upwardly at an angle of 45° of less with respect to the side walls. The upper ends of the discharge spouts are supported by brackets 70,72 to the respective side walls. Downwardly extending end portions 74, 76 of the spouts are provided to discharge ore fines downwardly into a suitable receptacle, not shown.

A discharge chute 78 is mounted at the upper side of end wall for discharging ore, rocks, stones and clay and talc dissolved in water into a suitable tank or receptacle, not shown. The chute preferably is U-shaped in cross section and is mounted about a cut-out opening 80 formed in the upper margin of end wall 20. The level of discharge from the box is controlled by placing one or more boards 82, 84 across the opening 80. A plurality of discharge valves 86, 88 are mounted in the bottom wall 14 for purposes of discharging slimes and other residue which accumulates in the bottom of the box.

The radii of arcuate corners 24, 26, 28 and 30 are preferably within the range of one-fourth to one-half of the vertical distance between the lowermost screen 42 and bottom wall 14. In the illustrated embodiment the radii of the corners is about one-half of such vertical distance.

Figure 3:
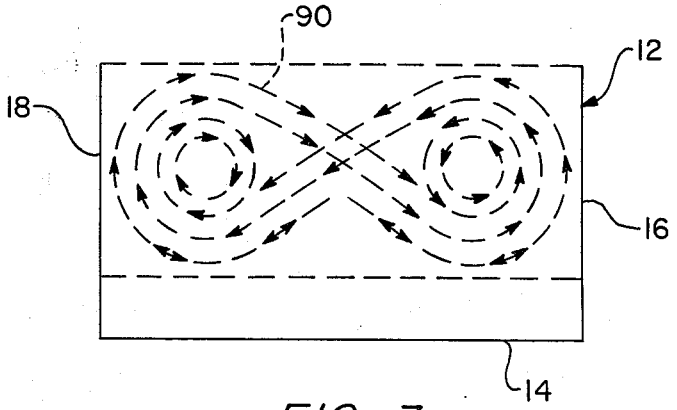
FIG. 3 is a schematic cross sectional view similar to FIG. 2 illustrating the figure eight path of movement of a charge of material within the box of the machine.

In operation a charge of material such as rock containing gold ore is deposited into the box from conveyor 62 and a volume of water is injected from pipe 64. The eccentric drive is then operated to reciprocate the rod 60 which in turn causes the box to simultaneously roll and rock over the rollers. The relatively large size radius of the corners 24–30, in combination with the rolling and rocking action which is imparted to the box, causes the contained charge to be directed in a generally figure eight path 90. The schematic of FIG. 3 illustrates the movement of individual particles of the charge within the box along such a figure eight path. The resulting movement of the charge against and through the screens achieves a more complete and uniform circulation and mixing action so that the screening and washing is more complete and efficient as compared to similar types of ore washing machines. Particles within the box such as rocks and ore are free to move in a complete circuit along the figure eight path so that the ore fines are readily screened downwardly while the larger sized rocks and stones are more completely washed as they gradually advance for discharge through chute 78. At the same time, the arcuate corners preclude the packing of residue or sediments within the box corners. Moreover, the provision of setting the discharge spouts 66 and 68 at an upwardly inclined angle of 45° or less with respect to the side walls provides for a more efficient separation of ore fines, such as gold, platinum, silver, and titanium, from the box. Microscopic particles of the ore, such as gold, can be retrieved downstream of the discharge spouts.

While the foregoing embodiment is at present considered to be preferred, it is understood that numerous variations and modifications may be made therein by those skilled in the art, and it is intended to cover in the appended claims all such variations and modifications as fall within the true spirit and scope of the invention.

What is claimed is:

1. In an ore washing machine, the combination of an elongate box having a bottom wall, a pair of spaced sidewalls, and a pair of spaced end walls, a plurality of horizontal screens mounted juxtaposed together in stacked relationship within the box at substantially the mid-span of the side and end walls, means forming inwardly concave surfaces for joining the bottom wall with the side and end walls, said concave surfaces having radii sized within the range of one-fourth to one-half of the vertical distance of the lowermost screen from the bottom wall, roller means disposed along an axis which is below the mid-span of the bottom wall and is parallel with the longitudinal axis of the box for supporting the box for simultaneous rolling and rocking movement in a direction transverse of said longitudinal axis, operating arm means connected with a sidewall of the box at a position substantially on the level of the lowermost screen, drive means for imparting a reciprocating force having periodically varying horizontal and vertical components to the arm means for simultaneously rolling and rocking the box on the roller means, means for directing a charge of ore material and water into one end of the box above the screens whereby the particles or ore and water in the charge are caused to move transversely of the box in substantially a figure eight path by the coaction of the concave surfaces with said rolling and rocking movement of the box with the lower portion of said path passing through the screens whereby a volume of the charge is successively moved back and forth through the screens, a discharge chute at the other end of the box for discharging coarse material from the charge which does not pass through the screens, and at least one fine ore discharge spout connected through one of said sidewalls at a position below said screens and which spout extends upwardly therefrom for discharging ore fines from the box.

2. An ore washing machine as in claim 1 in which the fine ore discharge spout extends upwardly at an angle of at most 45° with the side wall in a plane which is perpendicular to said longitudinal axis.

3. An ore washing machine as in claim 2 in which said means forming the concave surfaces includes a pair of arcuate corners which extend between respective side walls and the bottom wall.

4. An ore washing machine as in claim 3 in which said means forming the concave surfaces further includes a second pair of arcuate corners which extend between respective end walls and the bottom wall.

* * * * *